US009545178B2

(12) United States Patent
Schaffer et al.

(10) Patent No.: US 9,545,178 B2
(45) Date of Patent: Jan. 17, 2017

(54) SHOWER FLOOR

(71) Applicant: Fin-Pan, Inc., Hamilton, OH (US)

(72) Inventors: Lisa K. Schaffer, Hamilton, OH (US); Ryan D. Schaffer, West Chester, OH (US); Jason T. Clear, Oxford, OH (US)

(73) Assignee: Fin-Pan, Inc., Hamilton, OH (US)

( * ) Notice: Subject to any disclaimer, the term of this patent is extended or adjusted under 35 U.S.C. 154(b) by 190 days.

(21) Appl. No.: 14/211,133

(22) Filed: Mar. 14, 2014

(65) Prior Publication Data

US 2014/0259371 A1 Sep. 18, 2014

Related U.S. Application Data

(60) Provisional application No. 61/787,411, filed on Mar. 15, 2013.

(51) Int. Cl.
*A47K 3/00* (2006.01)
*A47K 3/40* (2006.01)

(52) U.S. Cl.
CPC *A47K 3/405* (2013.01); *A47K 3/00* (2013.01)

(58) Field of Classification Search
CPC ..... A47K 3/40
USPC ..... 4/596–613
See application file for complete search history.

(56) References Cited

U.S. PATENT DOCUMENTS

| | | | | |
|---|---|---|---|---|
| 5,956,912 | A | 9/1999 | Carter et al. | |
| 7,735,279 | B2 | 6/2010 | Paradis et al. | |
| 8,474,069 | B1 * | 7/2013 | Whitinger | E03F 5/0408 4/613 |
| 2002/0124504 | A1 | 9/2002 | Maylon et al. | |

FOREIGN PATENT DOCUMENTS

| | | | | |
|---|---|---|---|---|
| DE | 2407546 | A1 | 8/1975 | |
| DE | 4010403 | A1 | 10/1991 | |
| EP | 1785534 | A1 | 5/2007 | |
| EP | 1905922 | A2 | 4/2008 | |
| FR | 2898372 | A1 | 9/2007 | |
| GB | 2431936 | A | 5/2007 | |
| GB | 2 483 660 | A * | 3/2012 | A47K 3/281 |
| GB | 2483660 | A | 3/2012 | |
| WO | 2006039397 | A1 | 4/2006 | |

OTHER PUBLICATIONS

International Searching Authority, Search Report and Written Opinion Issued in Corresponding International Application No. PCT/US2014/028267 dated Jul. 25, 2014, 10 pages.

* cited by examiner

*Primary Examiner* — Lori Baker
(74) *Attorney, Agent, or Firm* — Wood Herron & Evans LLP

(57) ABSTRACT

A shower pan provides a shower floor adjoining a surrounding bathroom floor with no raised lip, curb or other obstruction between the two. This allows easy wheeled access for the disabled and comprises a drain plate in combination with an underlayment, which provide a gradual slope from a surrounding floor to a drain and supported on unmodified joists with upper surfaces in the same plane as surrounding bathroom floor joists.

10 Claims, 8 Drawing Sheets

SHOWER FLOOR

PRIORITY

Benefit of the Mar. 15, 2013 filing date of the U.S. Provisional Application Ser. No. 61/787,411 is claimed; and that application is expressly incorporated herein by reference as if fully set out herein.

FIELD OF THE INVENTION

This invention relates to shower floors and more particularly apparatus for building shower floors to meet compliance with the Americans with Disabilities Act. The invention more specifically relates to the construction of shower floors without lips, curbs, sills or other obstructions at transitions of shower floors to surrounding floors.

BACKGROUND OF THE INVENTION

Typically, shower floors or areas are set off or separated from surrounding floor surfaces such as bathroom floors by a curb or lip defining edges of the shower area and preventing water deposits, overflow, spray or the like on the adjacent or surrounding floor of a bathroom, for example. While of traditional construction, any such raised curb, lip, sill or the like constitutes an upstanding barrier between the shower floor and the surrounding or adjacent floor area such as the other floor surface in a bathroom.

While these barriers work well to contain water within the shower floor area, they constitute barriers to ingress and egress from the shower area, particularly for disabled persons. For example, if a person is confined to or must rely on a wheeled device for transfer into a shower area from an adjacent bathroom floor, that device must transit any upstanding lip, curb or sill. Frequently, these elements do not permit transfer of or block the wheeled device such as a chair or other support into or from a shower area.

In order to overcome this inherent difficulty, architects and builders attempt to install a shower floor with no lip, curb or sill. Typically, this is accomplished by "notching" or cutting out portions of the shower-underlying floor joists so a shower floor can be installed at a lower level, even with the surrounding floor and without an upstanding lip, curb or sill. Such a process entails the lowering of the subfloor to the notched-out joist tops and the provision of drain, tile and the like thereon. This permits a wheeled support device such as a wheelchair to be easily wheeled into and from the shower floor and to the surrounding bathroom floor.

Nevertheless, such process involves inherent disadvantages, severely limiting the possibility of such construction. First, "notching" the underlying floor joists by cutting away upper portions thereof can substantially weaken the underlying joists. Additional weight of any mud bed (mortar) further weakens such a floor.

Such a prior art construction is shown in elevational cross-section in FIG. 1 herein.

Such constructions are limited since builders use minimal dimension joists which cannot be notched without structural weakening and costly structural engineering involvement. Moreover, some builders are using engineered joists or joists of synthetic material which cannot be notched or cut out at the site.

Accordingly, it is one objective of the invention to provide apparatus and process for installing a shower floor without lip, curb, sill or other upstanding element between the shower floor and surrounding floor and without notching or weakening underlying support joists.

A further objective has been to provide a sloped water-draining shower floor extending from a surrounding floor without break or obstruction and without modifying underlying support joists.

A further objective has been to provide a sloped, water-draining shower floor extending from a surrounding floor without any raised obstruction and over supporting joists having upper edges at the same height as supporting joists underlying the surrounding floor.

A further objective has been to provide improved shower floor components and combinations thereof providing continuous smooth interfacing with surrounding floor areas without intervening lip, curb or sills and supported with standard, non-modified joists.

SUMMARY OF THE INVENTION

These and other objectives and advantages are obtained in a preferred embodiment of the invention by use of a unique drain plate combined with a rigid underlayment supported on the top edges of non-modified original joists.

That underlayment also rests on the tops of in-place floor joists, not modified in any way. A relatively thin mortar bed is sloped from the upper surface of the drain plate up to the upper surfaces of the tile underlayment of an adjacent floor. A membrane covers the underlayment, mortar bed and drain plate and a layer of thin set adhesive is applied to secure tile thereover.

Accordingly, there is no lip, curb or sill across the adjacent edges of the shower floor or adjacent bathroom floor, water-tightness across both is assured, weight is reduced and no changes are required in any joists. Drain placement is virtually unlimited between joists. The drain plate edge itself functions as a screed pivot point to produce the desired slope from there to the upper surface of surrounding or adjacent backer board.

These and other aspects of the invention will become readily apparent from the following written description and from the attached drawings in which:

DETAILED DESCRIPTION OF THE INVENTION

Figure 1:
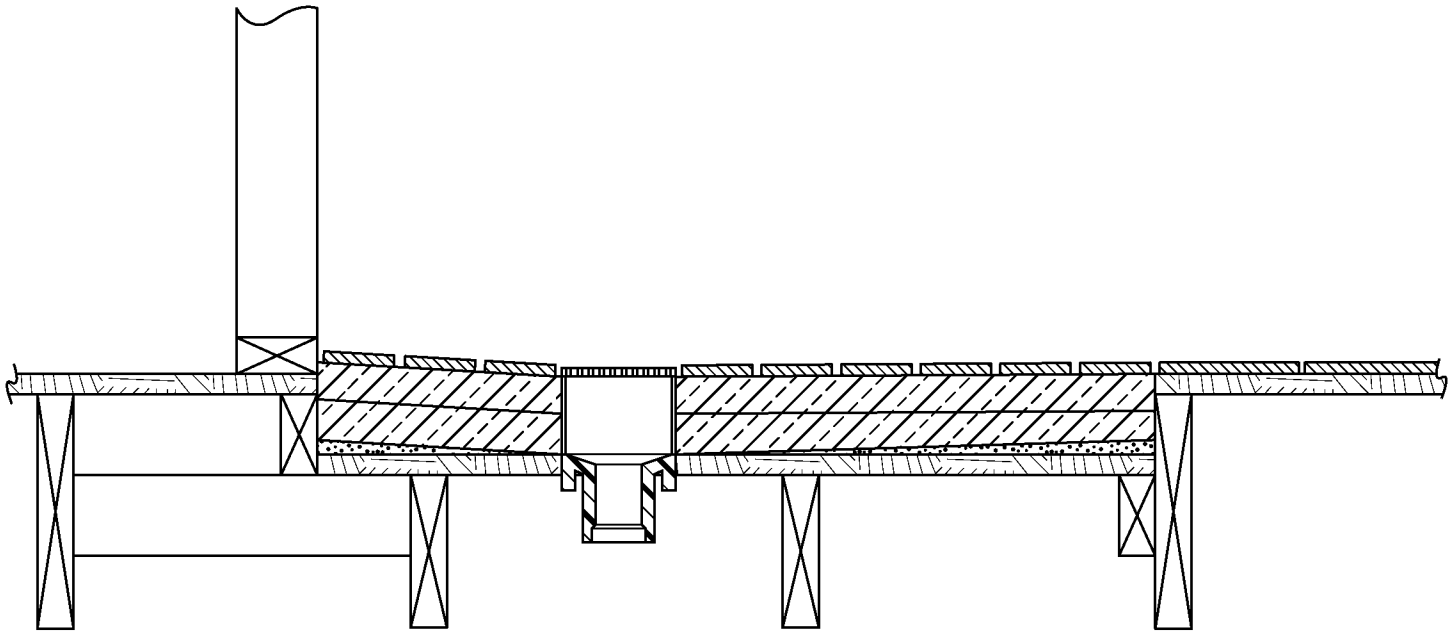
FIG. 1 PRIOR ART
FIG. 1 is a cross-sectional view of a prior art form of a shower floor built over notched-out floor joists.

FIG. 1 illustrates the prior art construction of a shower floor adjacent a bathroom floor. This bathroom floor comprises a plywood subfloor, tile underlayment and tile finish surface.

The prior shower floor components of FIG. 1 include, from bottom up, a plywood subfloor, a pre-sloped material, a pvc membrane, a thick mortar bed and tile, with a drain fixture.

Note in this construction the two notched joists with 2×4 blocking as additional support. The upper edges of the notched joists have been cut out in the overlying subfloor lowered thereon and lie below the level of the top edges of the joists of the adjacent floor. The tile on the shower floor is sloped to the drain and extends smoothly from the tile over the surrounding, or adjacent floor.

As noted, upper edges of the two notched floor joists are oriented below the upper edges of the joists which are not notched or modified under the surrounding floor. The left side of the drain illustrates a studded shower wall over a traditional subfloor.

Thus, traditional construction to avoid transitional breaks or obstacles across the adjacent floors requires joist modification.

Turning now to FIGS. 2-9, the drain plate of the invention will be described. Construction of a shower floor according to the invention, with the drain plate, is further described with reference to these FIGS.

Figure 3:
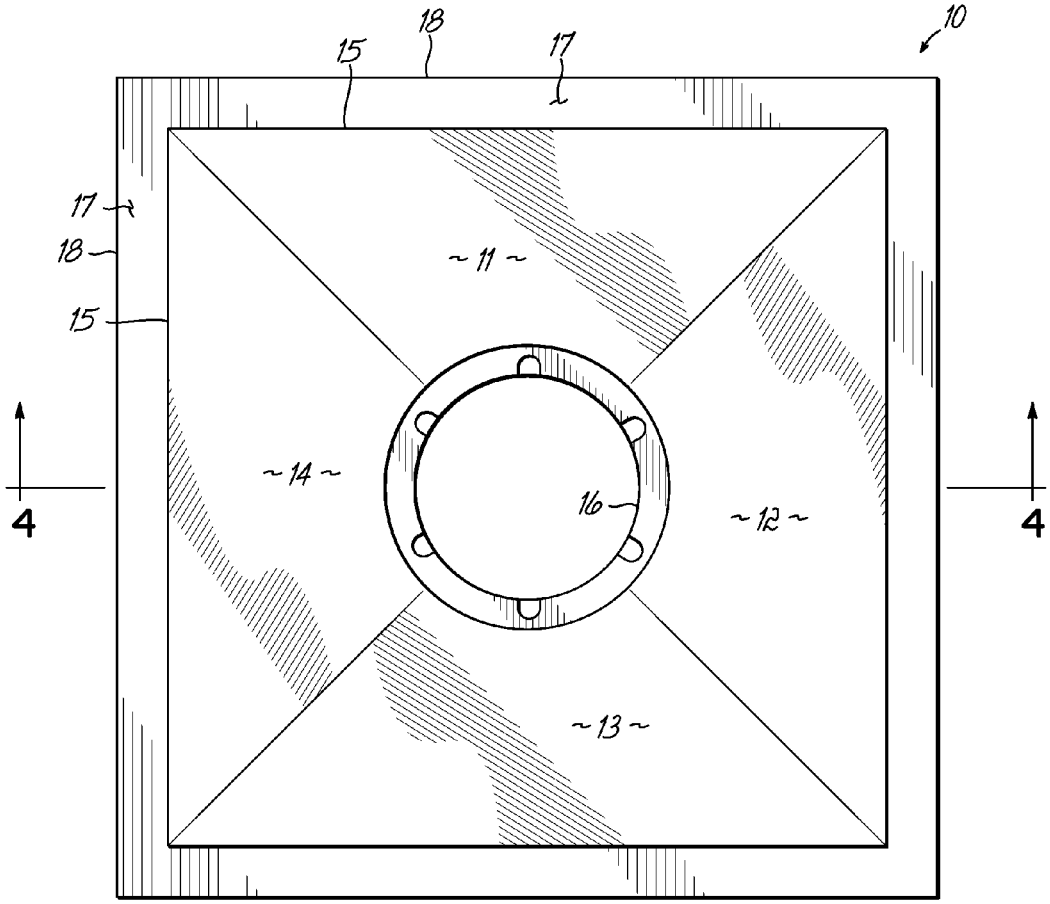
FIG. 3 is a top, plan view of the drain plate of the invention.

FIG. 3 is a top plan view of a drain plate 10 according to the invention. Plate 10 is preferably made of any suitable synthetic material and comprises four panels on surfaces 11-14 sloped downwardly (FIG. 4) from an edge 15 along each panel 11-14 to a center aperture 16.

Figure 4:
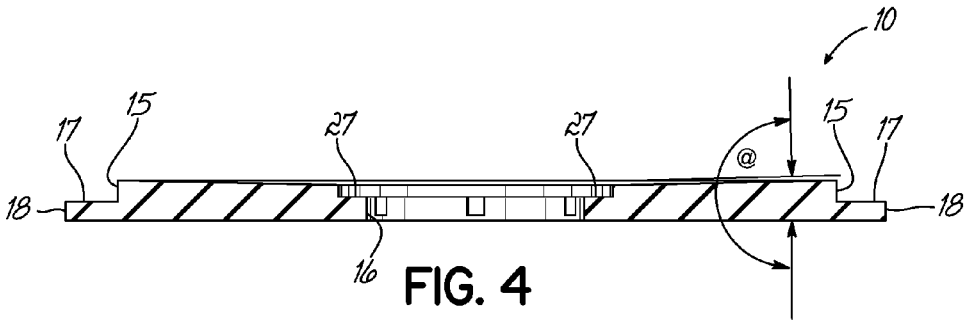
FIG. 4 is a cross-sectional view taken along lines 4-4 of FIG. 3.
Figure 5:
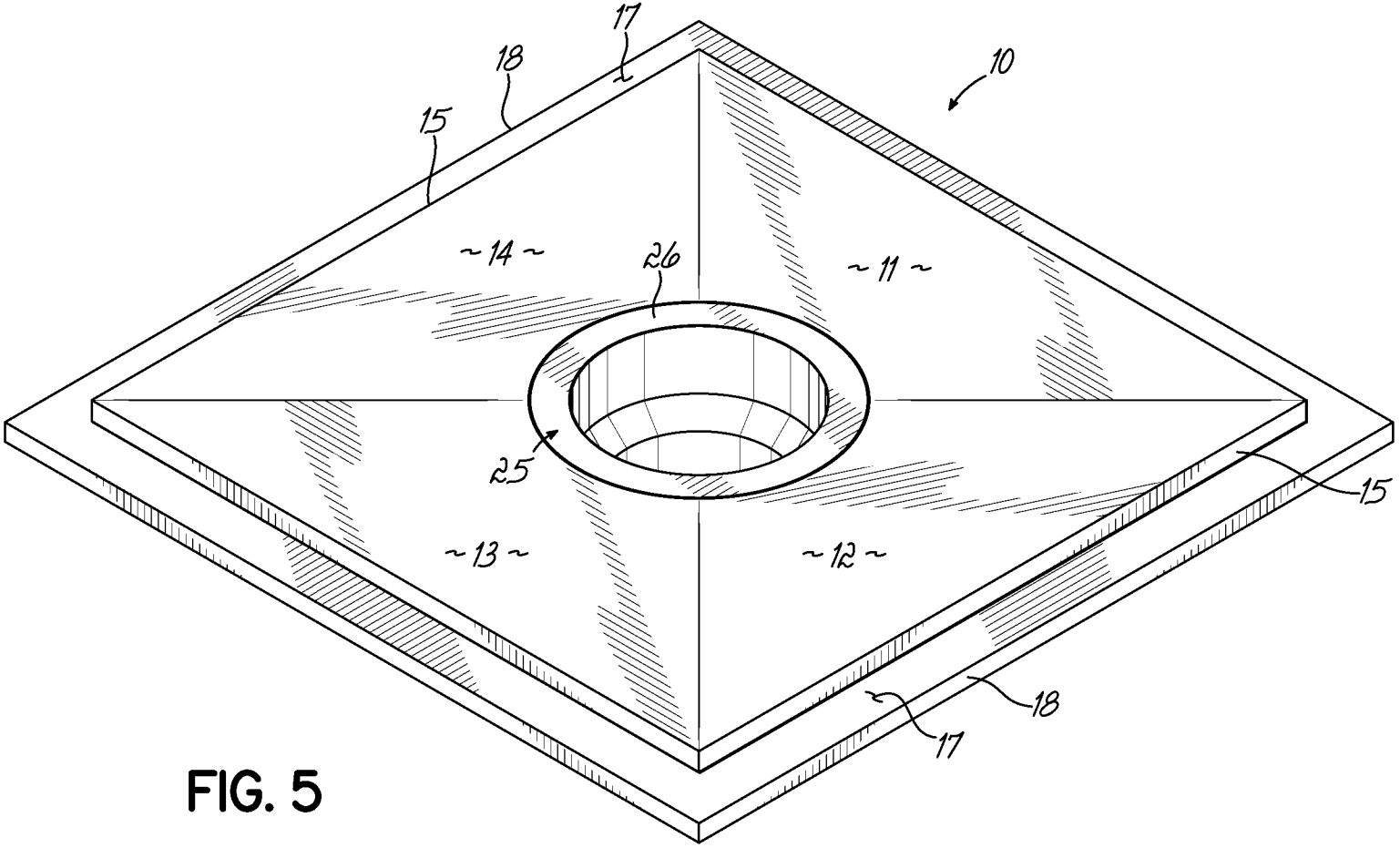
FIG. 5 is a plan view of the top of the drain plate of FIGS. 2-4 showing a drain fitting therein.
Figure 6:
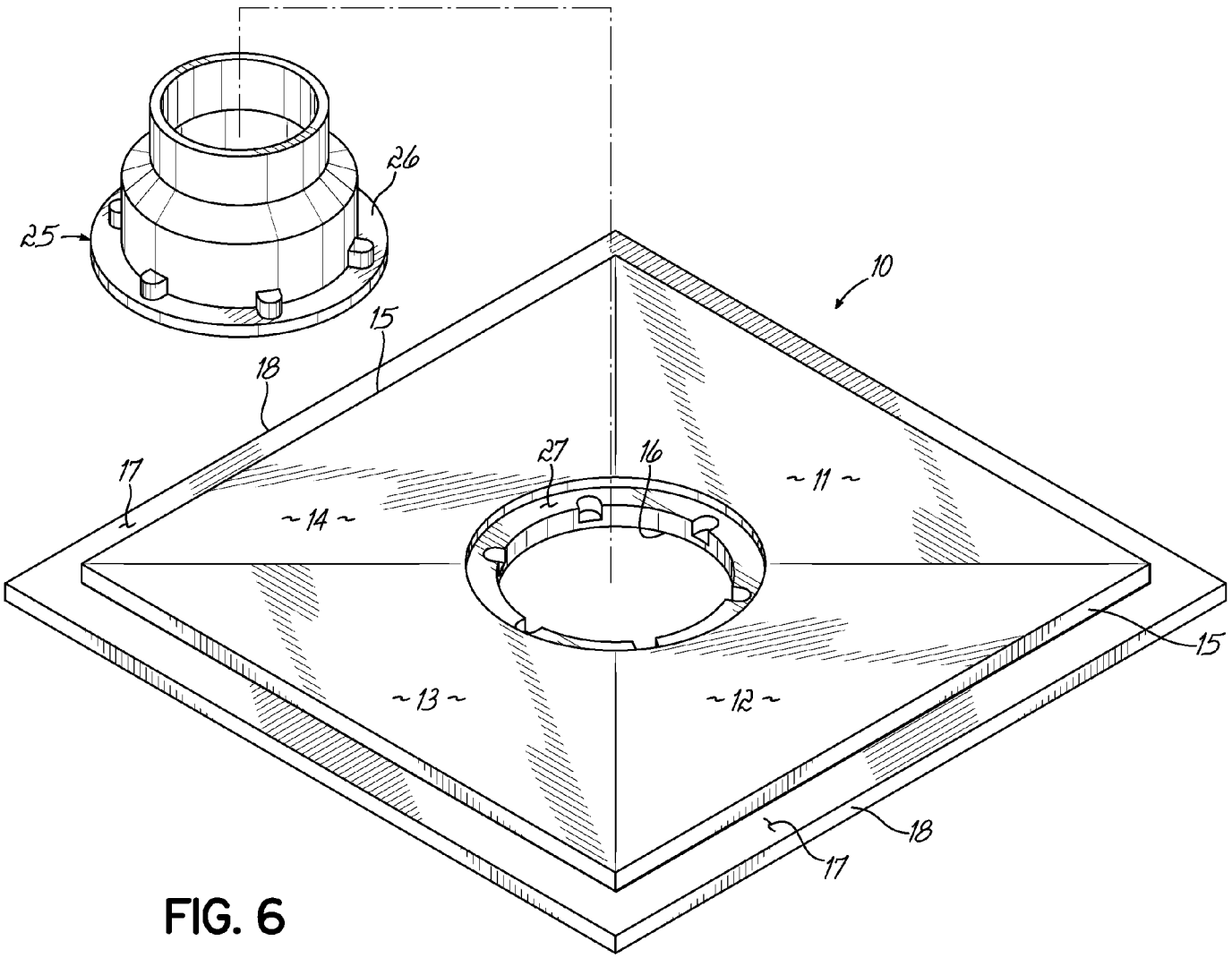
FIG. 6 is a view similar to FIG. 5 but showing the drain fitting removed and inverted for clarity.
Figure 7:
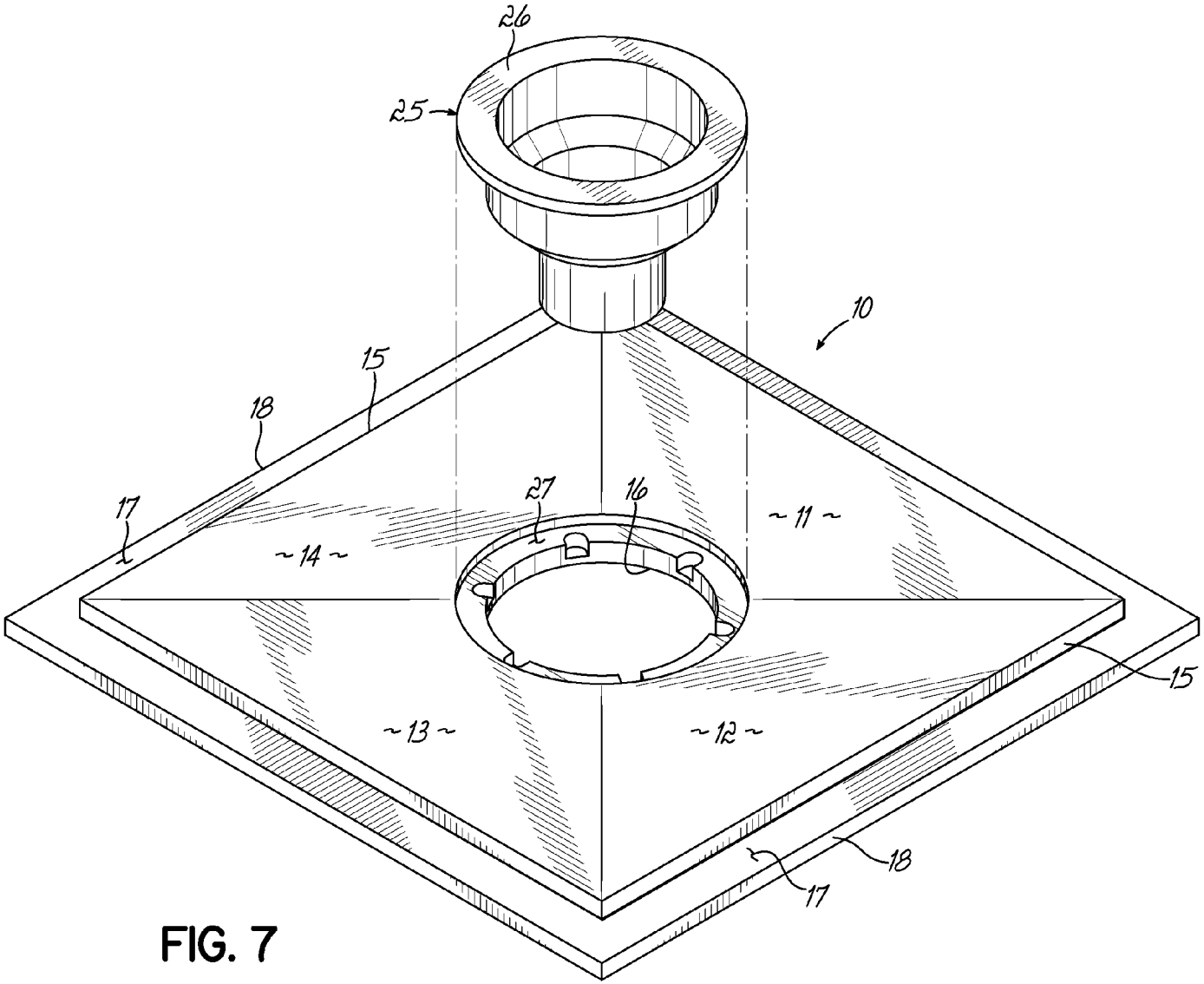
FIG. 7 is a view similar to FIG. 5 but showing the drain fitting in upright orientation spaced from the drain plate but not inverted.

FIG. 4 illustrates a slight downward slope in panel surfaces 11-14 to aperture 16 but it will be appreciated that the plate 10 is preferably of integral one-piece or monolithic construction, such as pivoted by molding or any other suitable process. The slope of the panels 11-14 to aperture 16 is indicated by angle alpha @ in FIG. 4, and is preferably less than 180 degrees (i.e. the slope declining preferable 1 to 2 degrees from horizontal).

Plate 10 has an outer surrounding flange or upwardly facing ledge surface 17 along the panels 11-14 and terminating in an outer edge 18.

Plate 10 is provided with a drain fixture 25, having a flange 26 fitting on the shoulder 27 surrounding aperture 16. Preferably, fixture 25 is glued onto shoulder 27 (FIG. 7) and extends downwardly for connection to any suitable drain or waste line (not shown).

Figure 2:
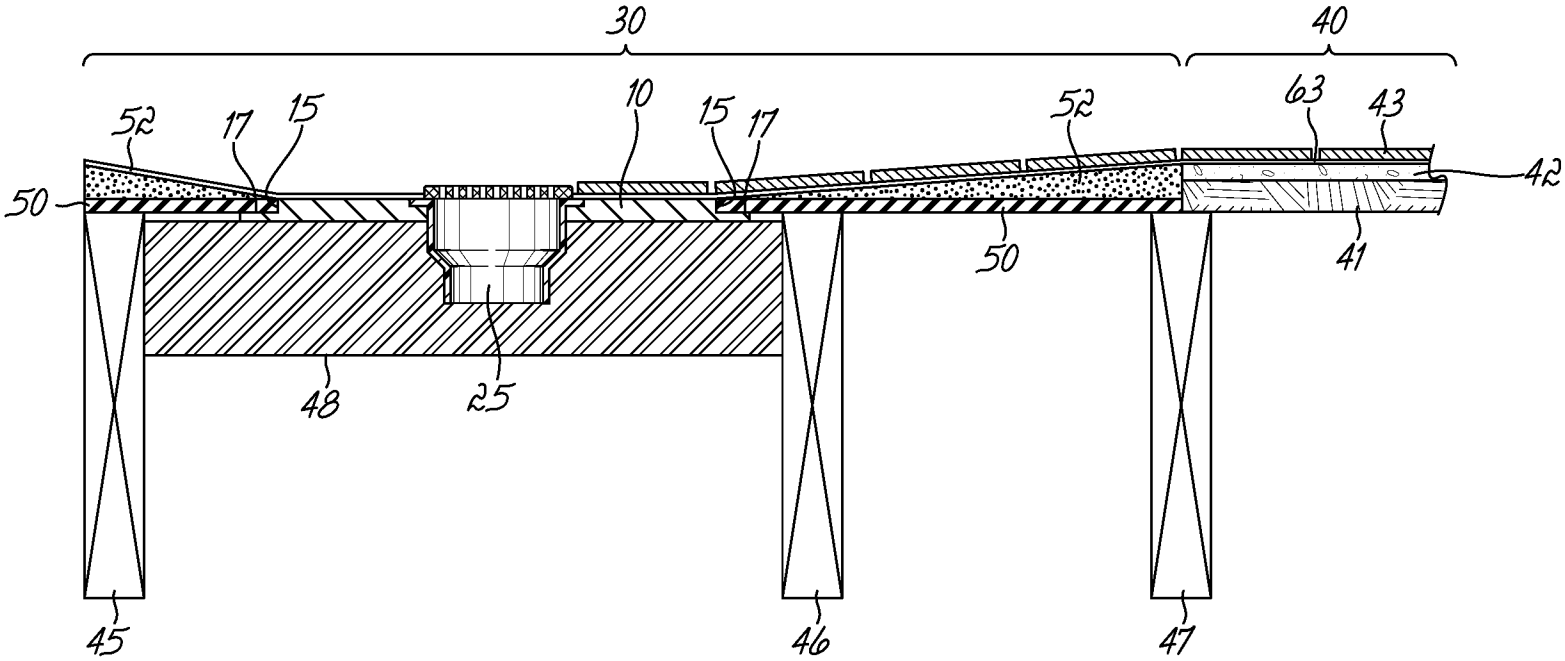
FIG. 2 is a cross-sectional view of one embodiment of the invention.

Turning now to FIG. 2, the integration of plate 10 in a shower floor area 30 is illustrated.

According to the invention as shown, shower floor area 30 is set over a plurality of joists 45, 46 having the same spatial orientation as joist 47 under an adjacent floor 40.

Floor 40, such as an adjacent bathroom floor, is comprised of a plywood subfloor 41, a suitable tile underlayment 42, a covering or tileable membrane such as chlorinated polyethylene (CPE) for example, and is tiled (as at 43).

Drain plate 10 is oriented preferably between joists 45, 46 as in FIG. 2 and is supported by cross-blocking 48 between joists 45, 46.

A rigid structural underlayment 50, such as the product disclosed in U.S. Pat. No. 7,735,279, incorporated herein by reference, extends from engagement on flange surface 17 of plate 10 over to the top edge of joist 47, for example, where underlayment 50 abuts subfloor 41. Underlayment 50 also extends around plate 10 preferably on all sides, resting on surrounding flanges or ledge surfaces 17 of plate 10 (FIG. 4).

A mortar bed 52 slopes from a level of the upper surface of tile underlayment 42 downwardly to the inner edge 15 of plate 10, thus providing a desirable drain slope. Edge 15 may act as a screed pivot during installation.

The tileable membrane (FIG. 2) is preferably continued over mortar bed 52 to the area proximate aperture 16 in plate 10.

Drain fixture 25 is extended through aperture 16 in plate 10 to an appropriate drain/waste connection as illustrated in FIG. 2.

It will be appreciated that underlayment 50 is preferably a structural underlayment which is further described for other applications at the website www.tileyourdeck.com, incorporated herein by reference as well as in U.S. Pat. No. 7,735,279.

Consistent with these disclosures, underlayment 50 is a composite construction provided with a series of parallel, dove-tail shaped stiffening ribs 60 (see FIGS. 8 and 9), upstanding from a flat undersurface as shown.

Figure 8:
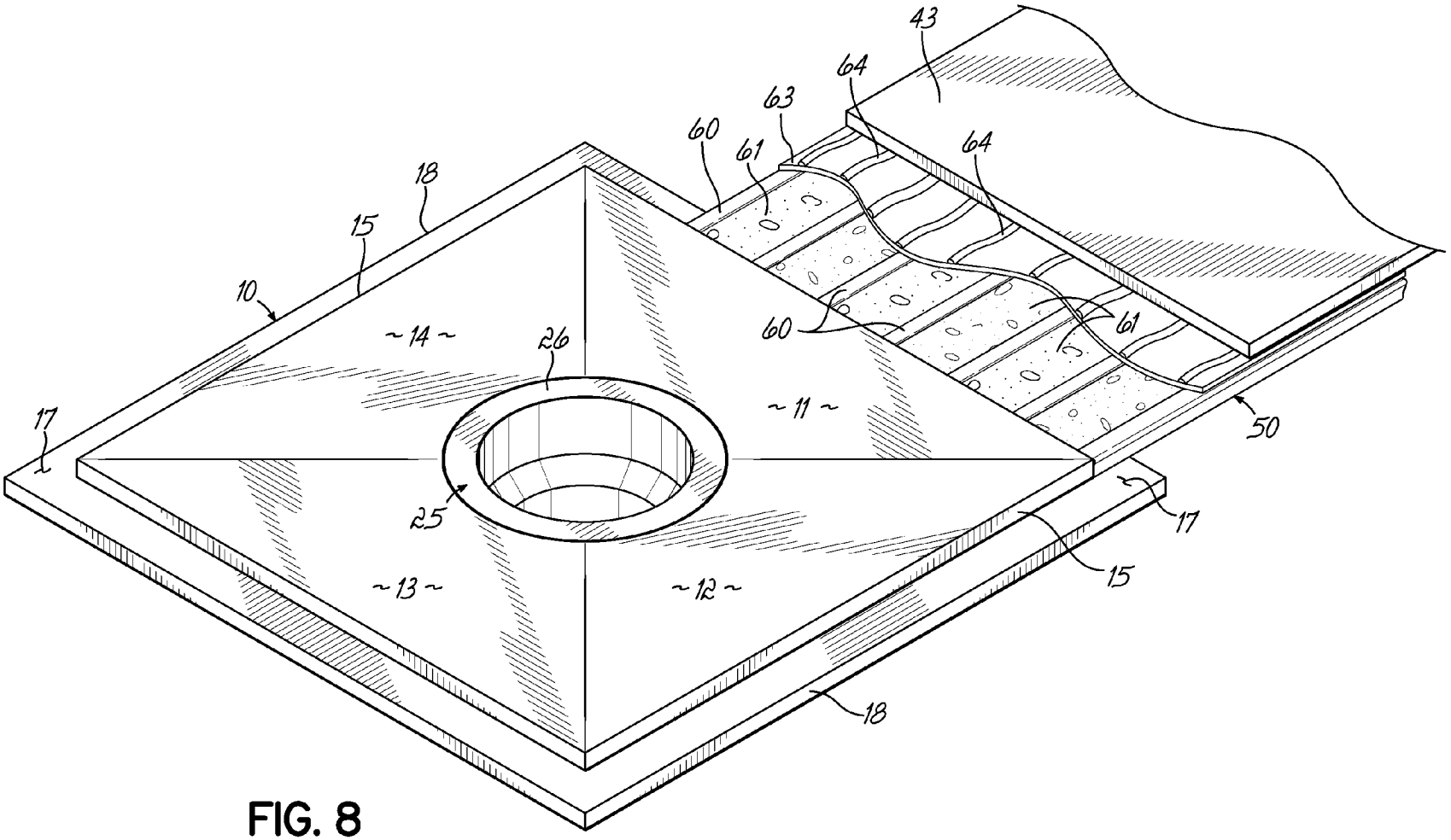
FIG. 8 is a view similar to FIG. 5 but illustrating the various components of the structural underlayment and the interface thereof with the drain plate.
Figure 9:
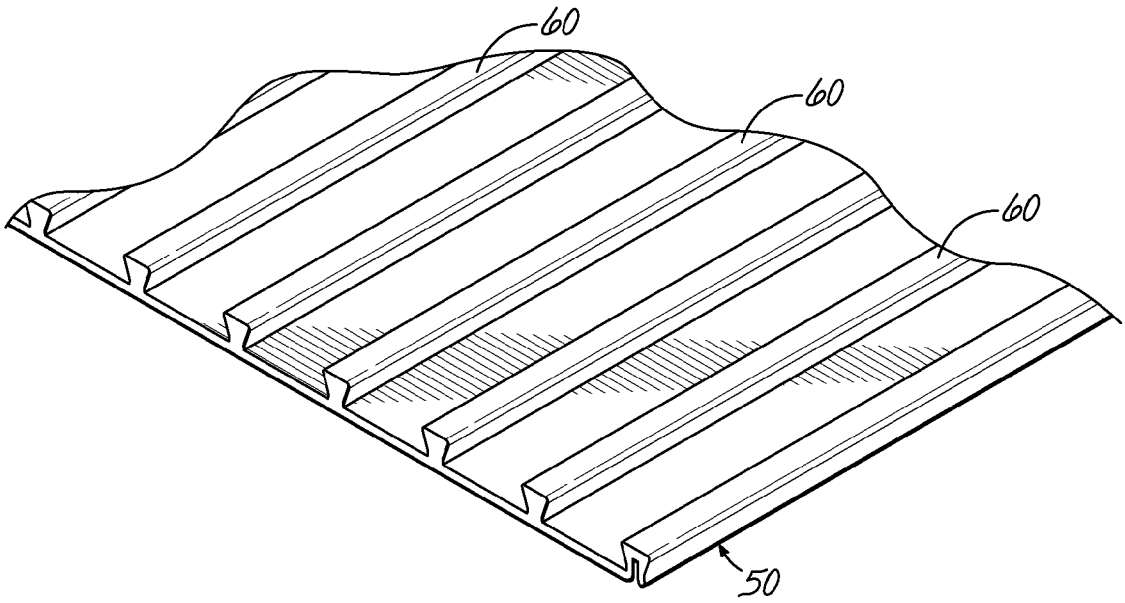
FIG. 9 is an isometric view of the underlayment.

More particularly, the interface between the underlayment 50 on flange surface 17 of plate 10, is illustrated in FIG. 8 with only a portion of underlayment 50 being shown. Underlayment 50 includes a flat undersurface with a plurality of parallel upstanding stiffening ridges 60 extending upwardly (FIG. 9). A mortar fill 61 (FIG. 8) is provided between these ridges 60, making for a very stiff, rigid underlayment with a mechanical bond to mortar bed 52. Tileable membrane 63 preferably defined as sheet or liquid is disposed on mortar bed 52 and a thin-set adhesive 64 is disposed thereon to secure tile 43 thereto. Only portions of these elements are illustrated in FIG. 8 for clarity.

Underlayment 50, mortar bed 52, membrane 63 and tile are oriented around and over plate 10 to complete shower floor 30 (FIG. 2).

It will be appreciated that, as illustrated in FIG. 2, there are no lips, curbs, sills or other breaks or obstructions between adjacent floors 30 and 40, so access therebetween by wheeled assistance devices is not impeded. At the same time, joists 45, 46 under floor 30 are not modified, notched or otherwise designed, placed or oriented any differently than other regular floor joists 47; the shower floor is well-supported and lighter than the prior floor (FIG. 1) and the shower floor is watertight and may be tiled while providing adequate drain slope.

What is claimed is:

1. A shower floor for installation over floor joists, in a shower floor area, said shower floor comprising:

an integral drain plate having a plurality of sloped surfaces and edge flanges;

a structural underlayment disposed directly on the tops of a plurality of said floor joists and on said edge flanges;

a mortar bed extending upwardly from a position above an upper level of said sloped surfaces of said drain plate over said underlayment to a position level with an upper surface of a tile underlayment defining a floor area adjacent said shower floor area.

2. A shower floor as in claim 1 further including a membrane operably disposed over said tile underlayment.

3. A shower floor as in claim 1 further including a membrane operably disposed over said mortar bed.

4. A shower floor as in claim 1 wherein said adjacent floor area is supported on floor joists having upper edges at a predetermined level, said shower floor supported on floor joists having upper edges at said predetermined level.

5. A shower floor as in claim 1, said underlayment extending from said drain plate portion to a position adjacent a subfloor component of said adjacent floor area.

6. A shower floor as in claim 1 wherein access between said shower floor and said adjacent floor area is not impeded.

7. A shower floor as in claim 1 wherein said shower floor slopes downwardly from a position directly adjacent a tile underlayment of said adjacent floor area.

8. An integral drain plate for a shower floor including a plurality of sections having surfaces sloping downwardly from outer edges of said sections to a drain aperture, and further including peripheral flanges proximate said outer edges and extending outwardly from said drain plate at a level lower than a portion of said surfaces.

9. A drain plate as in claim 8 for installation in a shower floor area adjacent a subfloor having a thickness, wherein said sections have a thickness extending above said peripheral flanges, said thickness being equal to said subfloor thickness.

10. An integral drain plate as in claim 8 wherein said sloping sections are pre-formed in said integral drain plate prior to use.

* * * * *